US008574002B2

(12) United States Patent
He et al.

(10) Patent No.: US 8,574,002 B2
(45) Date of Patent: Nov. 5, 2013

(54) CONNECTOR AND CONNECTING STRUCTURE OF FLEXIBLE FLAT CABLE

(75) Inventors: Chengming He, Shenzhen (CN); Yanxue Zhang, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 114 days.

(21) Appl. No.: 13/000,540

(22) PCT Filed: Dec. 8, 2010

(86) PCT No.: PCT/CN2010/079542

§ 371 (c)(1), (2), (4) Date: Apr. 4, 2011

(87) PCT Pub. No.: WO2012/055130

PCT Pub. Date: May 3, 2012

(65) Prior Publication Data

US 2012/0100749 A1 Apr. 26, 2012

(30) Foreign Application Priority Data

Oct. 25, 2010 (CN) ..... 2010 1 0520355

(51) Int. Cl.
*H01R 12/00* (2006.01)

(52) U.S. Cl.
USPC ..... 439/495; 439/67

(58) Field of Classification Search
USPC ..... 439/67, 492, 495
See application file for complete search history.

(56) References Cited

U.S. PATENT DOCUMENTS

| | | | | | |
|---|---|---|---|---|---|
| 3,980,375 | A | * | 9/1976 | LaMarche | 439/495 |
| 4,252,393 | A | * | 2/1981 | Johnson | 439/260 |
| 4,579,413 | A | * | 4/1986 | Weidler | 439/398 |
| 4,725,248 | A | | 2/1988 | Yasumoto | |
| 2005/0287865 | A1 | | 12/2005 | Wang et al. | |

FOREIGN PATENT DOCUMENTS

| | | | |
|---|---|---|---|
| CN | 1734848 | A | 2/2006 |
| CN | 2924831 | Y | 7/2007 |
| CN | 201018032 | Y | 2/2008 |
| CN | 201345438 | Y | 11/2009 |

* cited by examiner

*Primary Examiner* — Khiem Nguyen
(74) *Attorney, Agent, or Firm* — Sughrue Mion, PLLC

(57) ABSTRACT

A connector and a connecting structure of a flexible flat cable are provided. The connector includes a main body, an electrical terminal and a cover plate. The main body has a sidewall and a boss. The sidewall and the boss define a groove therebetween. The electrical terminal is in a bent shape. One end of the electrical terminal is disposed on the boss. The cover plate has a cover portion and an engaging portion. The cover portion covers on the boss. The engaging portion is inserted into the groove of the main body. The electrical terminal is partially located between the boss and the cover plate. The present invention further provides the connecting structure of a flexible flat cable. The advantage of the present invention is that: by disposing the groove on the main body, the cover plate is inserted into the groove for engaging the flexible flat cable connected to the connector, thereby preventing the flexible flat cable from releasing from connector to increasing the mounting reliability.

10 Claims, 4 Drawing Sheets

CONNECTOR AND CONNECTING STRUCTURE OF FLEXIBLE FLAT CABLE

BACKGROUND OF THE INVENTION

1. Field of the Invention

The present invention relates to a manufacture field of a liquid crystal display, and more particularly to a connector and a connecting structure of a flexible flat cable.

2. Description of the Prior Art

Mass produced connector structures for connecting a flexible flat cable (FFC) are generally divided into two types: one of which is a common connector without special clamping design and this connector is easily released to result in the malfunction of the product in use; and the other one of which is that the FFC has two ear hooks on two sides thereof and the connector is designed with two bosses for engaging with the two ear hooks, respectively. Although this design solves the problem of releasing easily, there are three problems: Firstly, a mould is needed to manufacture the FFC with the two ear hooks, and the high manufacture precision for the FFC is needed, resulting in the increase of the cost. Secondly, the ear hooks on the two sides of the FFC will increase the width of the FFC, so as to result in the waste of material and the increase of the product cost. Thirdly, in use, the operator must assure that the ear hooks of the FFC have been engaged with the bosses, if fail to do this, the result is that the ear hooks of the FFC only loosely engage with the bosses, which will result in bad signal transmission, so as to influence the mounting reliability substantially.

BRIEF SUMMARY OF THE INVENTION

To solve the foregoing technical problems, an object of the present invention is to provide a connector and a connecting structure of a flexible flat cable, capable of solving the releasing problem of the flexible flat cable and the connector, enhancing the yield thereof and reducing the manufacturing cost.

To solve the foregoing technical problems, the present invention provides a connector, comprising a main body, an electrical terminal and a cover plate. The main body has a sidewall and a boss. The sidewall and the boss define a groove therebetween. The electrical terminal is in a bent shape. One end of the electrical terminal is disposed on the main body. The cover plate has a cover portion and an engaging portion. The cover portion covers on the boss. The engaging portion is inserted into the groove of the main body.

As a selectable technical solution, the electrical terminal is partially disposed on the boss and located between the boss and the cover plate.

As a selectable technical solution, the height of the sidewall is greater than the height of the boss.

As a selectable technical solution, the cover plate is L-shaped.

As a selectable technical solution, an end portion of the engaging portion of the cover plate has an arc chamfer.

As a selectable technical solution, the main body also includes a bottom wall, and the boss is formed on a middle portion of the bottom wall.

As a selectable technical solution, the electrical terminal is disposed on the bottom wall and passes through the boss.

The present invention further provides a connecting structure of a flexible flat cable. The connecting structure of the flexible flat cable comprises: a connector, the connector comprising a main body, an electrical terminal and a cover plate, the main body having a sidewall and a boss, the sidewall and the boss defining a groove therebetween, the electrical terminal being in a bent shape, one end of the electrical terminal disposed on the boss, and the cover plate having a cover portion and an engaging portion; a flexible flat cable, one end of the flexible flat cable engaged against a portion of the electrical terminal on the boss and electrically connected thereto; a reinforcing plate, the reinforcing plate being L-shaped, the reinforcing plate having a covering portion and a reinforcing portion, the covering portion covering on the flexible flat cable, and the reinforcing portion inserted into the groove; the cover portion of the cover plate covering on the covering portion of the reinforcing plate, the engaging portion being inserted into the groove, and the reinforcing portion of the reinforcing plate located between the boss and the engaging portion; and the length of the reinforcing portion of the reinforcing plate being greater than the thickness of the flexible flat cable and the electrical terminal assembled together.

The present invention further provides a connecting structure of a flexible flat cable comprising a connector and a flexible flat cable. The connector comprises a main body, an electrical terminal and a cover plate. The main body has a sidewall and a boss. The sidewall and the boss define a groove therebetween. The electrical terminal is in a bent shape. One end of the electrical terminal is disposed on the main body, and the cover plate has a cover portion and an engaging portion. The flexible flat cable is electrically connected to the electrical terminal. The engaging portion of the cover plate is inserted into the groove. The cover portion covers on the flexible flat cable. The electrical terminal is disposed located between the main body and the flexible flat cable.

As a selectable technical solution, one end of the flexible flat cable is bent, and a bending portion of the flexible flat cable is inserted into the groove.

As a selectable technical solution, the electrical terminal is partially disposed on the boss and located between the boss and the cover plate, and the flexible flat cable is partially located between the electrical terminal and the cover plate.

As a selectable technical solution, a bending portion of the flexible flat cable is located between the engaging portion of the cover plate and the electrical terminal.

As a selectable technical solution, the connecting structure of the flexible flat cable also includes a reinforcing plate, the reinforcing plate being L-shaped, the reinforcing plate having a covering portion and a reinforcing portion, the covering portion covering on the flexible flat cable, and the reinforcing portion inserted into the groove; the cover portion of the cover plate covering on the covering portion of the reinforcing plate, the engaging portion inserted into the groove, and the reinforcing portion of the reinforcing plate located between the boss and the engaging portion.

As a selectable technical solution, the length of the reinforcing portion of the reinforcing plate is greater than the thickness of the flexible flat cable and the electrical terminal assembled together.

As a selectable technical solution, the connecting structure of the flexible flat cable also includes a reinforcing plate, the reinforcing plate being L-shaped, the reinforcing plate having a covering portion and a reinforcing portion, the covering portion covering on the flexible flat cable, and the reinforcing portion inserted into the groove; the cover portion of the cover plate covering on the covering portion of the reinforcing plate, the engaging portion inserted into the groove, and the reinforcing portion of the reinforcing plate located between the boss and the engaging portion.

As a selectable technical solution, the length of the reinforcing portion of the reinforcing plate is greater than the thickness of the flexible flat cable and the electrical terminal assembled together.

As a selectable technical solution, the main body also includes a bottom wall, and the boss is formed on a middle portion of the bottom wall.

As a selectable technical solution, the electrical terminal is disposed on the bottom wall and passes through the boss.

As a selectable technical solution, the height of the boss is less than or equal to the height of the flexible flat cable and the electrical terminal assembled together.

As a selectable technical solution, the height of the sidewall is greater than the height of the boss.

The advantage of the present invention is that: by disposing the groove on the main body, the cover plate is inserted into the groove for engaging with the flexible flat cable connected to the connector. The flexible flat cable is clipped by the cover plate and the boss for preventing the flexible flat cable from slipping outward, thereby preventing the flexible flat cable from releasing from the connector and increasing the mounting reliability of the flexible flat cable and the connector.

DETAILED DESCRIPTION OF THE PREFERRED EMBODIMENTS

The following text with reference to the accompanying drawings is a detail description for the preferred embodiment of a connector, a connecting structure of a flexible flat cable provided by the present invention.

For more clearly and easily understanding the object, the feature and the advantage of the present invention, the preferred embodiments with reference to the accompanying drawings now have been given for detail description. The specification of the present invention provides different examples for describing the technical features of the different embodiments of the present invention. Wherein, the configurations of all elements of the embodiments are intended to illustrate, but not to limit, the present invention. The labels of the elements of the different embodiments are partially repeated in the figures for simplifying the description and not intently indicating that the different embodiments have relevance.

Embodiment 1

Figure 1:
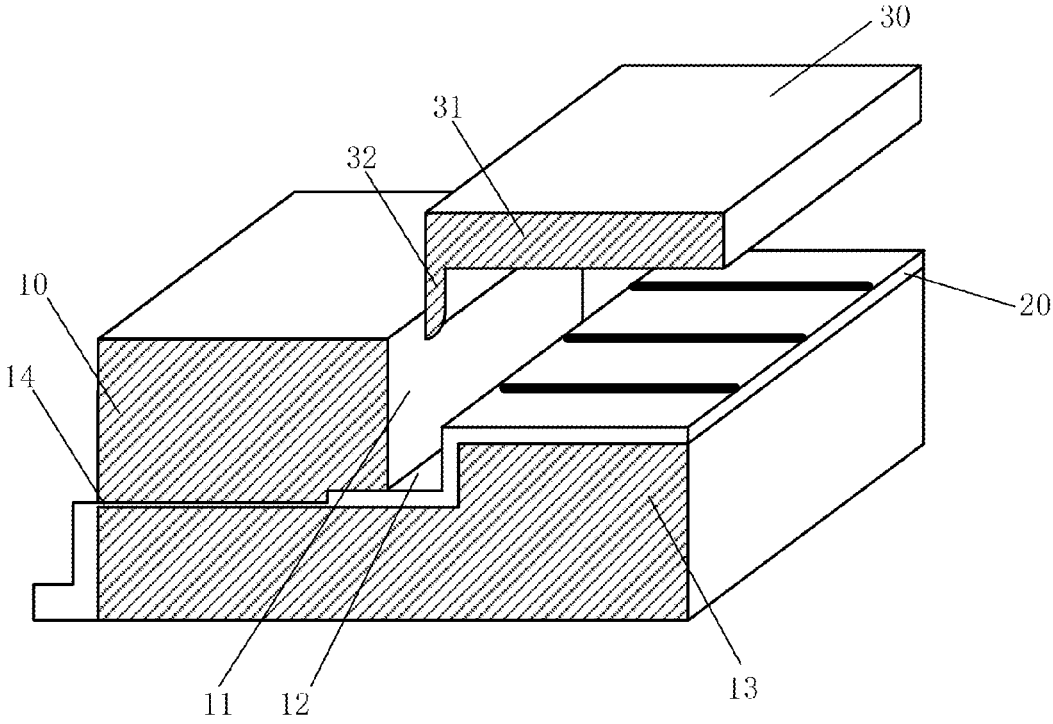
FIG. 1 is a schematic view of an exploded structure of a connector in a first embodiment of the present invention.

FIG. 1 shows a schematic view of an exploded structure of a connector in a first embodiment of the present invention. The connector comprises a main body 10, a plurality of electrical terminals 20 and a cover plate 30.

The main body 10 has a sidewall 11, a boss 13 and a groove 12 formed between the sidewall 11 and the boss 13. The height of the sidewall 11 is greater than that of the boss 13. The main body 10 further has a plurality of terminal grooves 14 passing through the sidewall 11 and being communicated with the groove 12.

The electrical terminal 20 is in a bent shape for resting on a top surface of the boss 13, a side of the groove 12 and a bottom surface of the groove 13, and for passing through the terminal groove 14 to extend out of the main body 10.

The cover plate 30 is L-shaped, having a cover portion 31 and an engaging portion 32 connected to the cover portion 31. As a preferred embodiment, the length of the engaging portion 32 should ensure that the engaging portion 32 could be embedded into the groove 12 after the cover plate 30 covers the groove 12.

Figure 2:
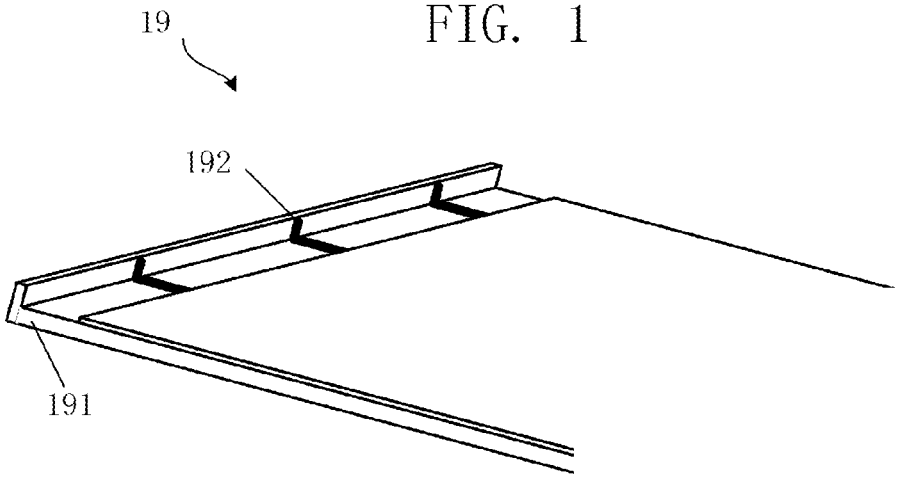
FIG. 2 is a structure schematic view of a flexible flat cable in the first embodiment of the present invention.

FIG. 2 is a structure schematic view of a flexible flat cable in the first embodiment of the present invention. The flexible flat cable 19 includes a wrapping layer 191 and a number of cable wires 192 being parallel arranged. The cable wires 192 are separated from each other by insulating material. One end of the flexible flat cable 19 is bent to form a bending portion, the cable wires 192 of which are exposed outside.

Figure 3:
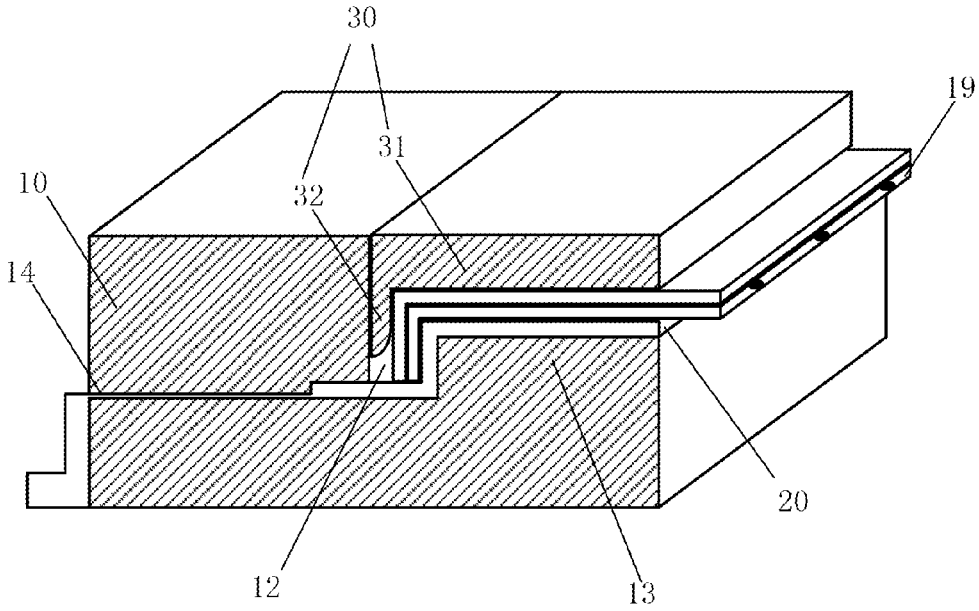
FIG. 3 is an assembly schematic view of a connecting structure of the flexible flat cable in the first embodiment of the present invention.

FIG. 3 is a structure schematic view after the connector shown in FIG. 1 and the flexible flat cable 19 shown in FIG. 2 are engaged together. The bending portion of the flexible flat cable 19 is inserted into the groove 12 and is electrically connected to the electrical terminals 20. The other portions of the flexible flat cable 19 cover the boss 13. The electrical terminals 20 are located between the boss 13 and the flexible flat cable 19.

The cover portion 31 of the cover plate 30 covers on the flexible flat cable 19. The engaging portion 32 is inserted into the groove 12. A distance between the cover plate 30 and a top end of the groove 12 should be equal to a sum of the thickness of the flexible flat cable 19 and the thickness of the electrical terminal 20. Therefore, the length of the engaging portion 32 should be substantially greater than the sum of the thickness of the flexible flat cable 19 and the thickness of the electrical terminal 20. An end portion of the engaging portion 32 of the cover plate 30 has an arc chamfer. The advantage thereof is that the engaging portion 32 can be smoothly inserted into a gap between the flexible flat cable 19 and the groove 12 during the course of assembly.

A distance between the engaging portion 32 of the cover plate 30 located in the groove 12 and the electrical terminal 20 is less than the thickness of the flexible flat cable 19 in the groove 12, specifically, should be slightly less than the thickness of the flexible flat cable 19. Because the flexible flat cable 19 is flexible, the fact that the distance of the engaging portion 32 and the electrical terminal 20 is less than the thickness of the flexible flat cable 19 means that: after the flexible flat cable 19 inserted into the groove 12 and then the engaging portion 32 is inserted into the groove 12, the engaging portion 32 and the electrical terminal 20 located on the side of the groove 12 can together extrude the flexible flat cable 19, thereby better fixing the flexible flat cable 19 in the connector.

In this embodiment, the boss 13 of the main body 10 can block the bending portion of the flexible flat cable 19 and the engaging portion 32 of the cover plate 30, and the engaging portion 32 clips the flexible flat cable 19, thereby efficiently preventing the flexible flat cable 19 from falling off the connector.

Embodiment 2

Figure 4:
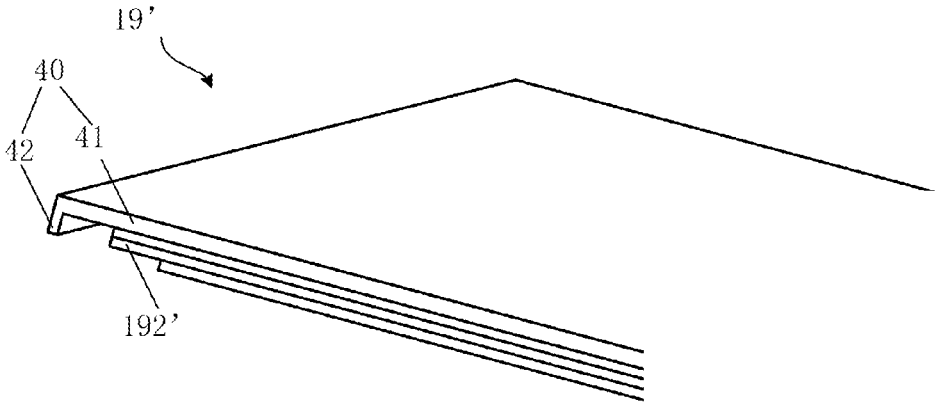
FIG. 4 is a schematic view of an exploded structure of a connecting structure of a flexible flat cable in a second embodiment of the present invention.

FIG. 4 is a schematic view of an exploded structure of a connecting structure of a flexible flat cable in a second embodiment of the present invention. In this embodiment, a composed structure of a connector is same as that of the connector of the first embodiment. In this embodiment, the connecting structure of the flexible flat cable has a difference from that of the first embodiment in that: the cable wires 192' on one end of the flexible flat cable 19' is exposed outside, the connecting structure of the flexible flat cable further has a reinforcing plate 40. The reinforcing plate 40 is L-shaped, having a covering portion 41 and a reinforcing portion 42 connected to the covering portion 41.

Figure 5:
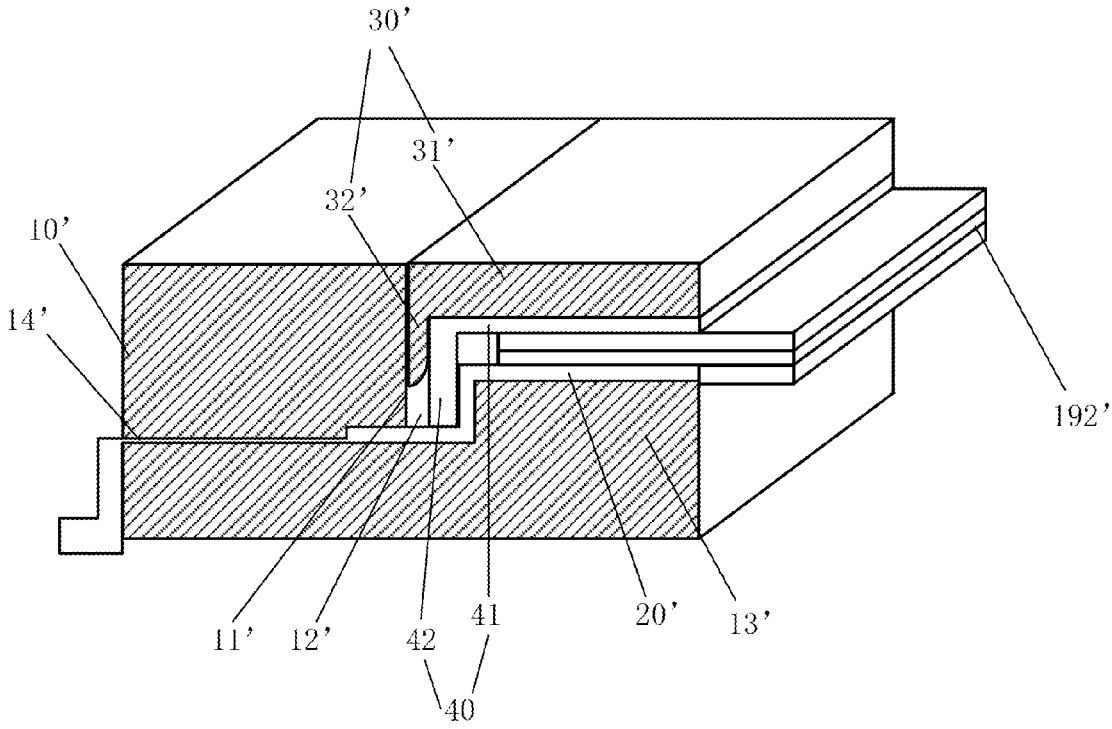
FIG. 5 is an assembly schematic view of the connecting structure of the flexible flat cable in the second embodiment of the present invention.

FIG. 5 is an assembly schematic view of the connecting structure of the flexible flat cable in the second embodiment of the present invention. Exposed ends of the cable wires 192' of the flexible flat cable 19' is engaged against a portion of the electrical terminal 20' on the boss 13' and are electrically connected to the electrical terminal 20'.

The covering portion 41 of the reinforcing plate 40 covers on the flexible flat cable 19', and the reinforcing portion 42 of the reinforcing plate 40 is inserted into the groove 12'. The length of the reinforcing portion 42 of the reinforcing plate 40 is greater than the thickness of the flexible flat cable 19' and the electrical terminals 20' assembled together, so that the reinforcing portion 42 of the reinforcing plate 40 may hold on the boss 13'.

The cover portion 31' of the cover plate 30' covers the covering portion 41 of the reinforcing plate 40. The engaging portion 32' is held between the reinforcing portion 42 of the reinforcing plate 40 and the sidewall 11' of the main body 10'.

In this embodiment, by means of the covering portion 41 of the reinforcing plate 40, the reinforcing portion 42 and the engaging portion 32' of the cover plate 30 engaging the flexible flat cable 19', the flexible flat cable 19' can be efficiently prevented from falling off the connector.

Embodiment 3

Figure 6:
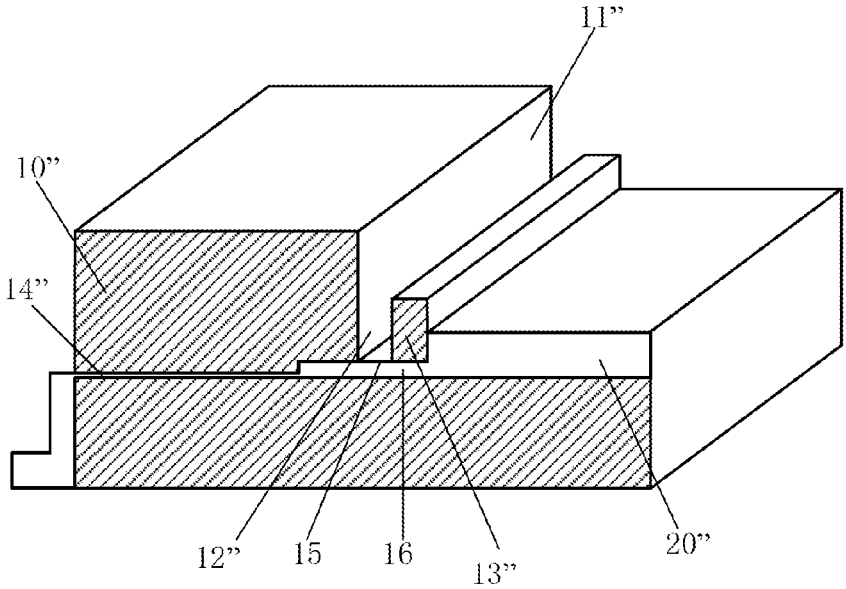
FIG. 6 is a schematic view of an exploded structure of a connecting structure of a flexible flat cable in a third embodiment of the present invention.

FIG. 6 is a schematic view of an exploded structure of a connecting structure of a flexible flat cable in a third embodiment of the present invention. In this embodiment, the flexible flat cable 19" and the reinforcing plate 40" is same as the structure of the flexible flat cable 19' and the reinforcing plate 40 of the second embodiment. In this embodiment, the main body 10" has a sidewall 11" and a bottom wall 15. A middle portion of the bottom wall 15 protrudes upward to form a boss 13", which is parallel to the sidewall 11". A groove 12" is defined between the boss 13" and the sidewall 11". A terminal groove 16 passes through the boss 13". The electrical terminal 20" is disposed on the bottom wall 15 of the main body 10", one end of which passes through the terminal groove 14" and extends out of the main body 10", and the other end of which passes through the terminal groove 16.

Figure 7:
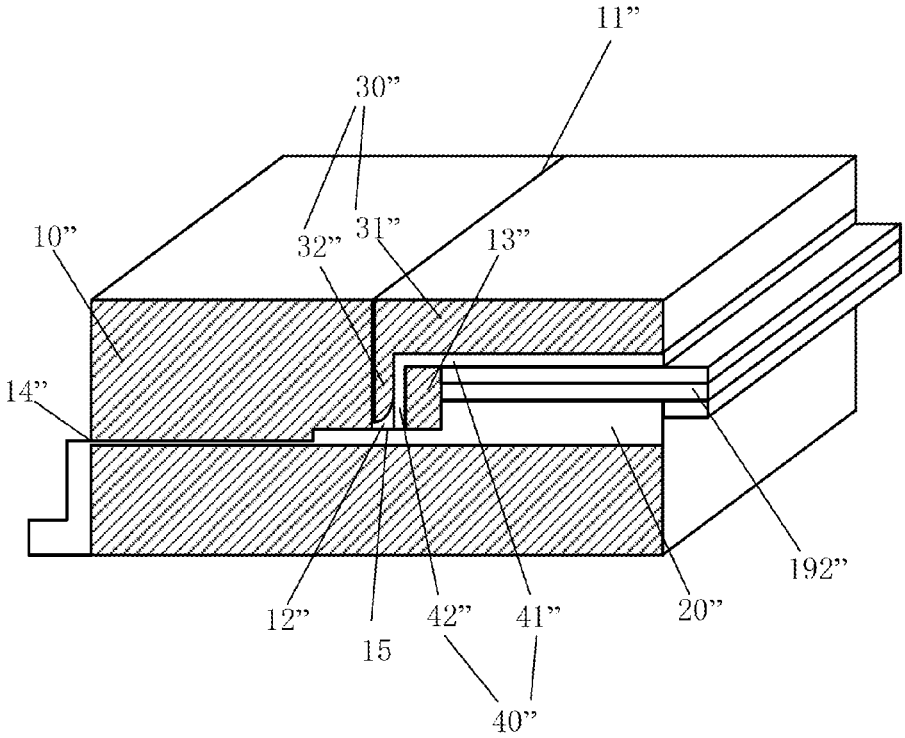
FIG. 7 is an assembly schematic view of the connecting structure of the flexible flat cable in the third embodiment of the present invention.

FIG. 7 is an assembly schematic view of the connecting structure of the flexible flat cable in the third embodiment of the present invention. The flexible flat cable 19" is engaged against one end of the electrical terminal 20", which is located on the bottom wall 15, and is electrically connected to the electrical terminal 20". The covering portion 41" of the reinforcing plate 40" covers on the flexible flat cable 19" and the boss 13". The reinforcing portion 42" of the reinforcing plate 40" is inserted into the groove 12". The cover portion 31" of the cover plate 30" covers on the covering portion 41" of the reinforcing plate 40". The engaging portion 32" of the cover plate 30" is held between the reinforcing portion 42" of the reinforcing plate 40" and the sidewall 11" of the main body 10".

The covering portion 41" of the reinforcing plate 40" covers on the flexible flat cable 19" and the boss 13". For making the reinforcing plate 40" be capable of efficiently retaining the flexible flat cable 19", the height of the boss 13" should be less than or equal to the height of the electrical terminal 20" and the flexible flat cable 19" assembled together.

In this embodiment, by means of the boss 13" and the groove 12" retaining the reinforcing plate 40", the reinforcing plate 40" can hold the flexible flat cable 19" thereby efficiently preventing the flexible flat cable 19" from falling off the connector.

The above are only the preferred embodiments of the present invention, it should be pointed out that any person having ordinary skills in the art also can make many improvement and amendment within the principles of the present invention, and the improvement and amendment also should be considered belonging to the protection scope of the present invention.

What is claimed is:

1. A connector, comprising a main body, an electrical terminal and a cover plate, characterized in that:

the main body having a sidewall and a boss, the sidewall and the boss defining a groove therebetween;

the electrical terminal being in a bent shape, one end of the electrical terminal disposed on the boss, wherein a flexible flat cable has one end engaged against a portion of the electrical terminal on the boss and electrically connected thereto; and the cover plate being L-shaped and having a cover portion and an engaging portion perpendicularly connected to the cover portion, the cover portion covering on the end of the flexible flat cable and the boss, and the engaging portion inserted into the groove of the main body.

2. The connector according to claim 1, characterized in that: the electrical terminal is partially disposed on the boss and located between the boss and the cover plate.

3. The connector according to claim 1, characterized in that: the height of the sidewall is greater than the height of the boss.

4. The connector according to claim 1, characterized in that: a reinforcing plate being L-shaped is provided and has a covering portion and a reinforcing portion, wherein the cover portion of the cover plate covers on the covering portion of the reinforcing plate which covers on the end of the flexible flat cable engaged against the portion of the electrical terminal on the boss, the engaging portion and the reinforcing portion are inserted into the groove, and the reinforcing portion of the reinforcing plate is located between the boss and the engaging portion.

5. The connector according to claim 1, characterized in that: an end portion of the engaging portion of the cover plate has an arc chamfer.

6. The connector according to claim 1, characterized in that: the main body also includes a bottom wall, and the boss is formed on a middle portion of the bottom wall.

7. The connector according to claim 6, characterized in that: the electrical terminal is disposed on the bottom wall and passes through the boss.

8. A connecting structure of a flexible flat cable, characterized in that: the connecting structure of the flexible flat cable comprises:

a connector, the connector comprising a main body, an electrical terminal and a cover plate, the main body having a sidewall and a boss, the sidewall and the boss defining a groove therebetween, the electrical terminal being in a bent shape, one end of the electrical terminal disposed on the boss, and the cover plate having a cover portion and an engaging portion;

a flexible flat cable, one end of the flexible flat cable engaged against a portion of the electrical terminal on the boss and electrically connected thereto;

a reinforcing plate, the reinforcing plate being L-shaped, the reinforcing plate having a covering portion and a reinforcing portion, the covering portion covering on the flexible flat cable, and the reinforcing portion inserted into the groove;

the cover portion of the cover plate covering on the covering portion of the reinforcing plate, the engaging portion inserted into the groove, and the reinforcing portion of the reinforcing plate located between the boss and the engaging portion; and a length of the reinforcing portion of the reinforcing plate being greater than the thickness of the flexible flat cable and the electrical terminal assembled together.

9. The connecting structure of the flexible flat cable according to claim 8, characterized in that: the height of the sidewall is greater than the height of the boss.

10. The connecting structure of the flexible flat cable according to claim 8, characterized in that: the cover plate is L-shaped, and an end portion of the engaging portion has an arc chamfer.

* * * * *